US008321963B2

(12) United States Patent
Diaz et al.

(10) Patent No.: US 8,321,963 B2
(45) Date of Patent: Dec. 4, 2012

(54) ARTICLE OF CLOTHING

(76) Inventors: Stephano Diaz, Long Island City, NY (US); Troy Mattison Hicks, Long Island City, NY (US)

( * ) Notice: Subject to any disclaimer, the term of this patent is extended or adjusted under 35 U.S.C. 154(b) by 261 days.

(21) Appl. No.: 12/660,549

(22) Filed: Mar. 2, 2010

(65) Prior Publication Data

US 2010/0229283 A1 Sep. 16, 2010

Related U.S. Application Data

(60) Provisional application No. 61/210,127, filed on Mar. 16, 2009.

(51) Int. Cl.
*A42B 5/00* (2006.01)

(52) U.S. Cl. ..... 2/207

(58) Field of Classification Search ..... 2/206, 208, 2/339, 244; 63/11, 5.1, 3; 132/273, 275
See application file for complete search history.

(56) References Cited

U.S. PATENT DOCUMENTS 1,655,973 A * 1/1928 Ross ..... 8/482
D92,603 S * 6/1934 James ..... D2/823
2,201,716 A * 5/1940 Davis, Jr. ..... 66/41
2,806,222 A * 9/1957 Carpenter ..... 2/91
2,858,541 A * 11/1958 Mangan ..... 2/113
4,342,260 A * 8/1982 Sala et al. ..... 101/126
4,723,325 A * 2/1988 Perry ..... 2/207
5,144,696 A * 9/1992 Kahl ..... 2/207
D339,545 S * 9/1993 Davies ..... D11/3
5,867,835 A * 2/1999 Dabbieri ..... 2/207
6,314,585 B1 * 11/2001 Mann ..... 2/243.1
6,779,237 B1 * 8/2004 Stoltenberg ..... 28/149
7,096,511 B2 * 8/2006 Cohen ..... 2/206
D537,609 S * 3/2007 Horowitz ..... D2/500
2007/0094768 A1 * 5/2007 Moudgill ..... 2/171
2007/0278264 A1 * 12/2007 Chesal et al. ..... 224/160

OTHER PUBLICATIONS

Dec52008tshirtscarf (Etsy screenshots) http://www.etsy.com/transaction/12242527.*
Dec52008tshirtscarf2 (Etsy screenshots) http://www.etsy.com/transaction/12242527.*

* cited by examiner

*Primary Examiner* — Khoa Huynh
*Assistant Examiner* — Anna Kinsaul
(74) *Attorney, Agent, or Firm* — Next IP Law Group LLP

(57) ABSTRACT

The present invention provides for an article of clothing adapted to function as a scarf, the scarf including: a large tubular fabric material cut into a plurality of loops of fabric, the loops of fabric are stretched to a desired length; and a band of fabric adapted to bind the plurality of loops to thereby form the scarf designed to be worn around a user's neck.

20 Claims, 6 Drawing Sheets

ARTICLE OF CLOTHING

RELATED APPLICATION

This application is related to U.S. Provisional Application Ser. No. 61/210,127 filed on Mar. 16, 2009 entitled "Article of Clothing".

BACKGROUND OF THE INVENTION

1. Field of the Invention

The present invention relates to an article of clothing and more particularly, a scarf comprising a plurality of loops of seamless fabric bound together by a band of fabric.

2. Description of the Related Art

There are numerous scarves, mufflers, wraps and shawls in the art. The present invention provides for an article of clothing, particularly a scarf that provides for a plurality of different fashion looks and styles.

SUMMARY OF THE INVENTION

In one embodiment, the present invention relates to an article of clothing which comprises: a plurality of loops of seamless fabric cut from a larger tubular fabric material, and the loops are stretched to allow fabric to roll onto itself; and a band of fabric adapted for binding the plurality of loops of fabric to create an article of clothing adapted to be worn around a user's neck.

In another embodiment, the loops of fabric are cut at a width from about ¼ inch to about 4 inches. In yet another embodiment, the loops of fabric are cut at a length from about 10 inches to about 30 inches.

In still another embodiment, the loops of fabric are cut at a width from about ¾ of an inch to about 1 inch. In still yet another embodiment, the band of fabric binds the plurality of loops of fabric using a fabric keychain loop knot. In a further embodiment, the knot is loose enough to allow each of the loops of fabric to slip through in any direction with ease. In another further embodiment, the article of clothing functions as a scarf.

In yet a further embodiment, the plurality of loops of fabric is wound around the user's head at least twice. In still a further embodiment, at least one of the loops is manipulated to create various looks.

In still yet a further embodiment, the tubular fabric material is dyed with color prior to cutting. In another embodiment, the tubular fabric material is screen printed with a pattern prior to cutting. In still yet another further embodiment, the loops of fabric are stretched to a length from about 16 inches to about 36 inches.

In another embodiment, the present invention provides for a scarf manufactured by a method comprising: providing a large tubular fabric material; cutting a plurality of loops of seamless fabric from the large tubular fabric material at a desired width; stretching each of the loops of fabric to a desired length and until the fabric rolls onto itself; providing a band of fabric and using said band to bind said plurality of loops and thereby form a scarf to be worn around a user's neck.

In yet another embodiment, the fabric is selected from a group comprising of cotton, polyester, silk, wool, cashmere, rayon, cotton jersey and mixtures thereof. In still another embodiment, the tubular fabric material is pre-printed with a design prior to cutting.

In a further embodiment, the present invention provides for an article of clothing adapted to function as a scarf, said scarf comprising: a large tubular fabric material cut into a plurality of loops of fabric, the loops of fabric are stretched to a desired length; and a band of fabric adapted to bind the plurality of loops to thereby form the scarf designed to be worn around a user's neck.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Figure 1:
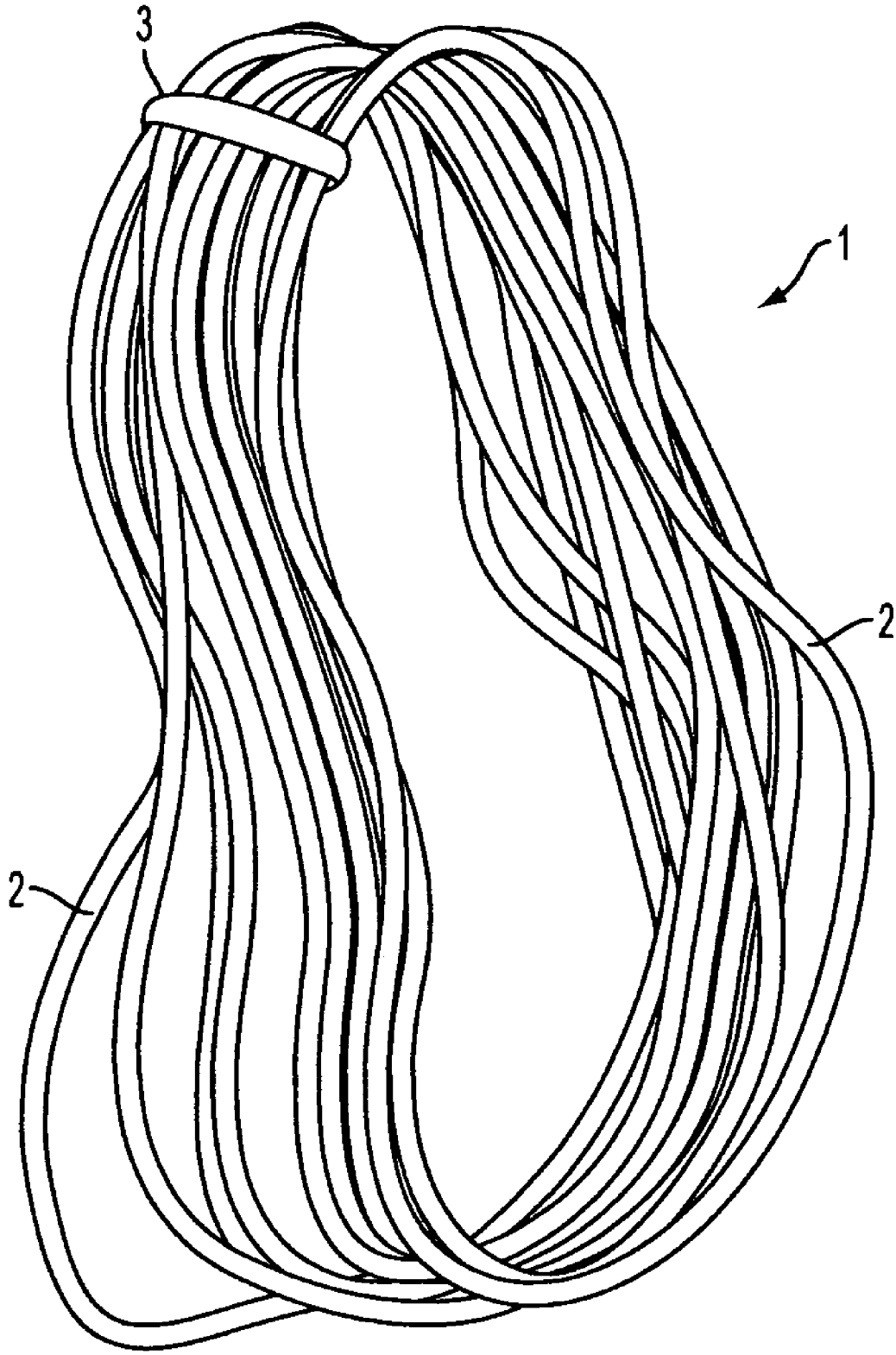
FIG. 1 is a front perspective view of one of the embodiments of the article of clothing of the present invention.
Figure 2:
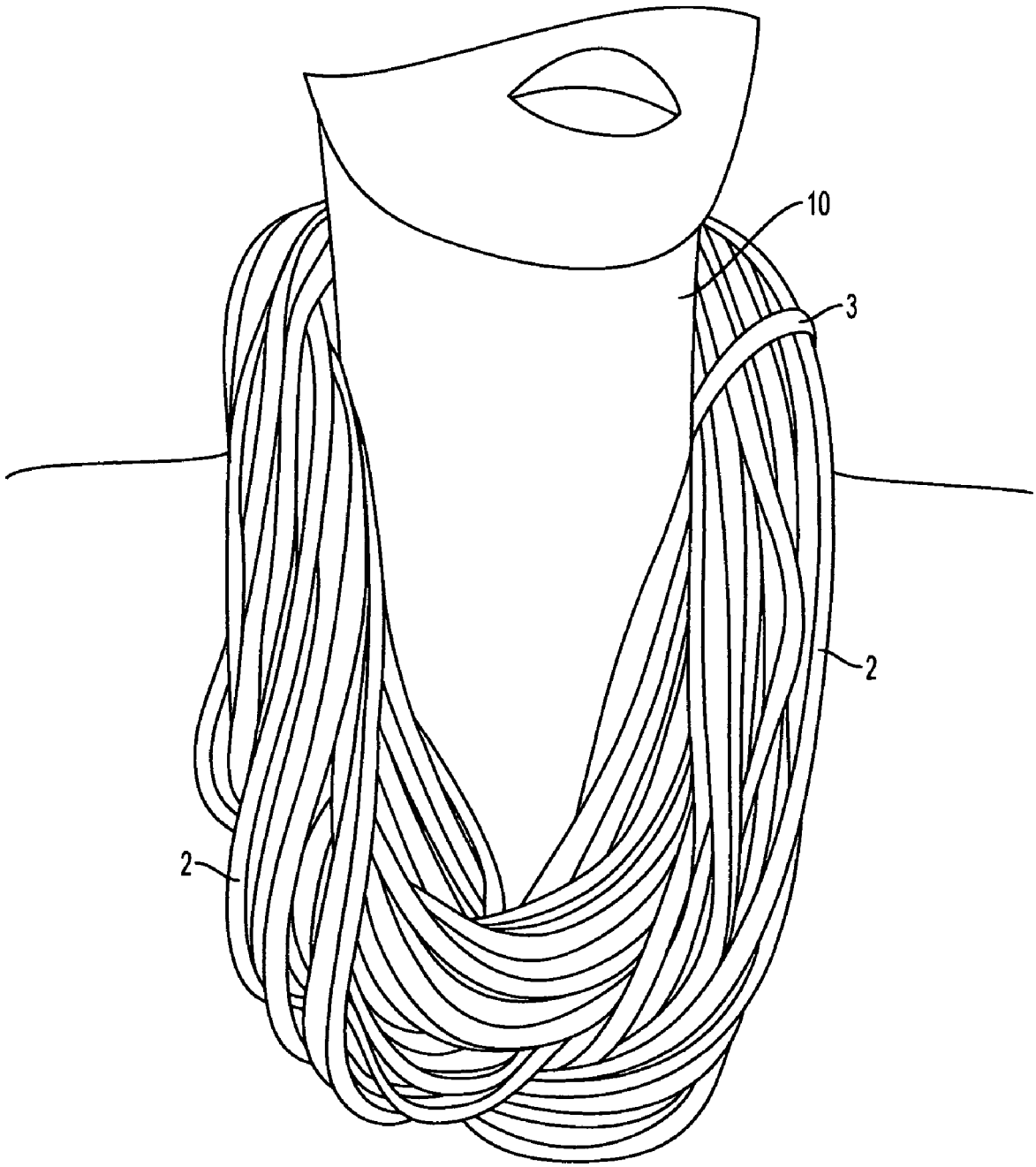
FIG. 2 is a perspective view of FIG. 1 showing the scarf worn around user's neck.

Referring now to FIGS. 1-2, the present invention provides article of clothing 1, specifically a scarf which comprises: a plurality of loops 2 of seamless fabric cut from a larger tubular fabric material, and the loops are stretched to allow fabric to roll onto itself; and a band 3 of fabric adapted for binding the plurality of loops of fabric to create an article of clothing adapted to be worn around a user's neck 10.

Figure 3:
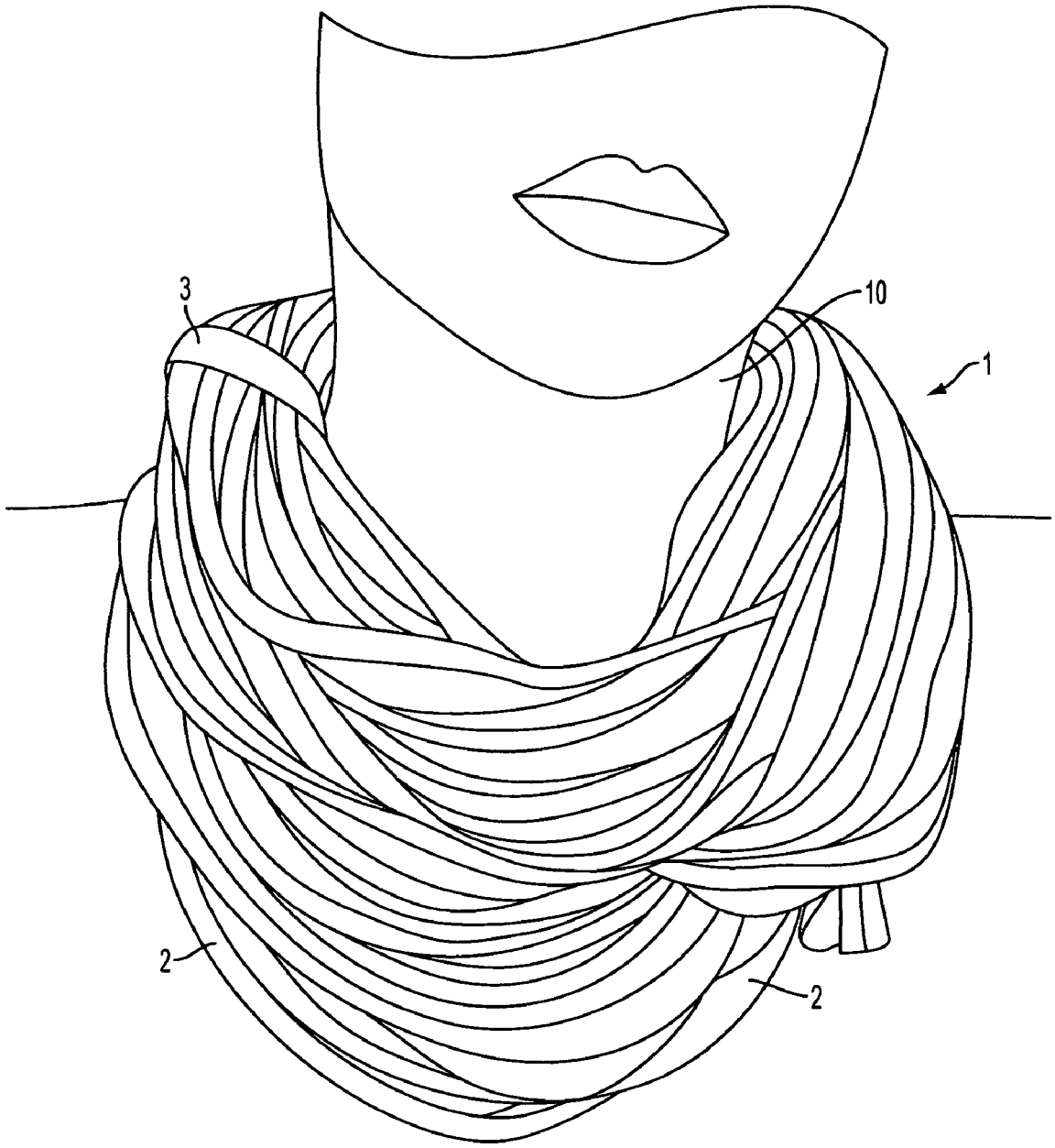
FIG. 3 is a perspective view of FIG. 1 showing the scarf wrapped around the user's neck twice.

FIG. 2 shows how the article of clothing 1 is placed around the user's neck 10 and the band of fabric 3 binds the plurality of loops 2 of fabric using a fabric keychain loop knot. The knot is loose enough to allow each of the loops 2 of fabric to slip through in any direction with ease. At least one of the loops 2 is manipulated to create various looks. FIG. 3 shows how the loops 2 of fabric are wound around the user's neck 10 at least twice.

Figure 4:
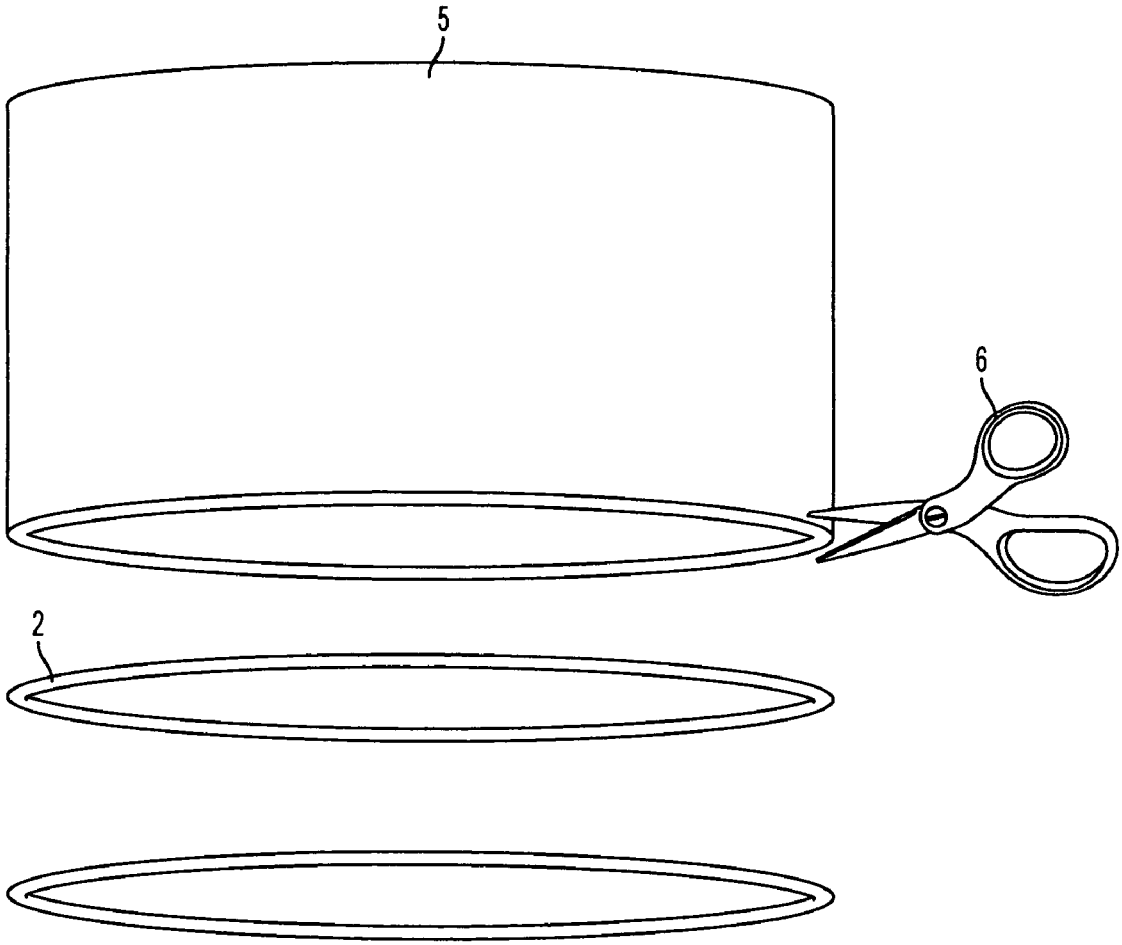
FIG. 4 is a perspective view of the method of manufacturing showing the loops of fabric being cut from the larger tubular fabric.
Figure 5:
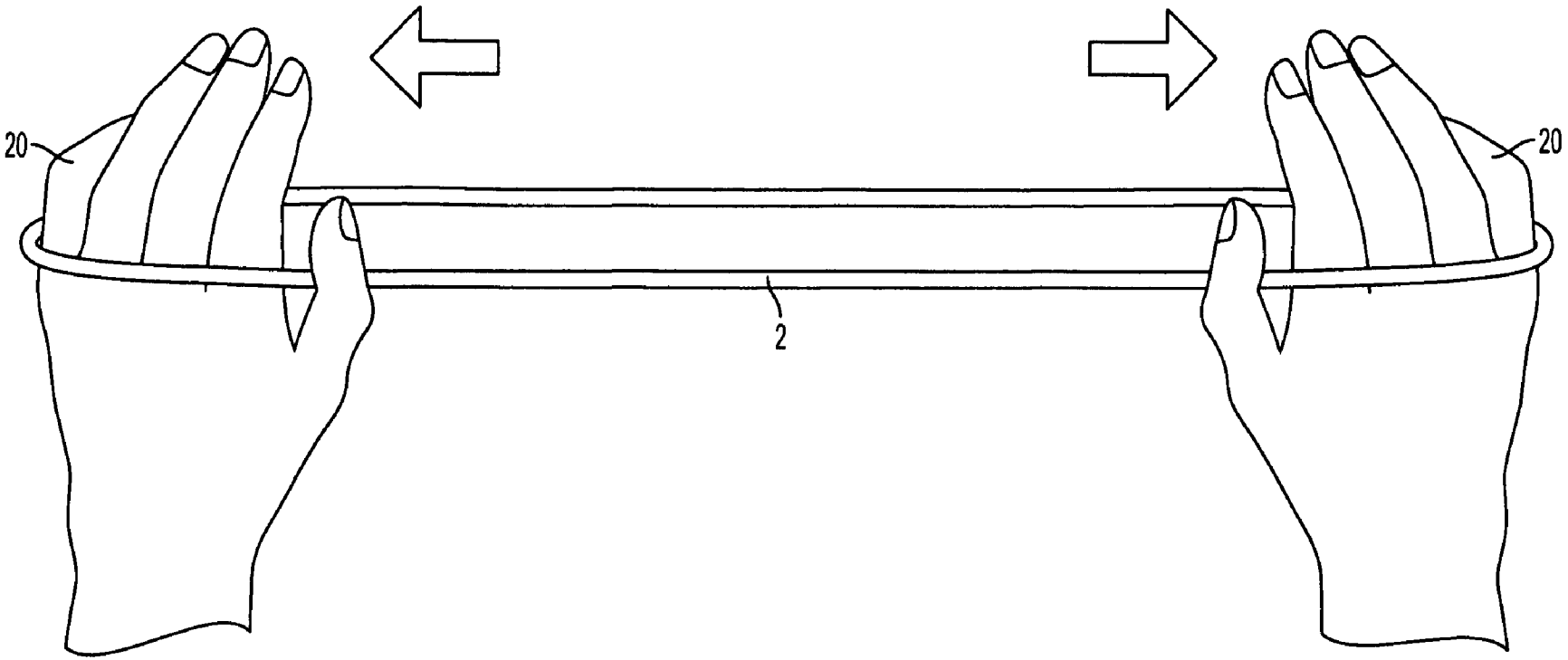
FIG. 5 is a perspective view following FIG. 4 showing the loops of fabric being stretched.
Figure 6:
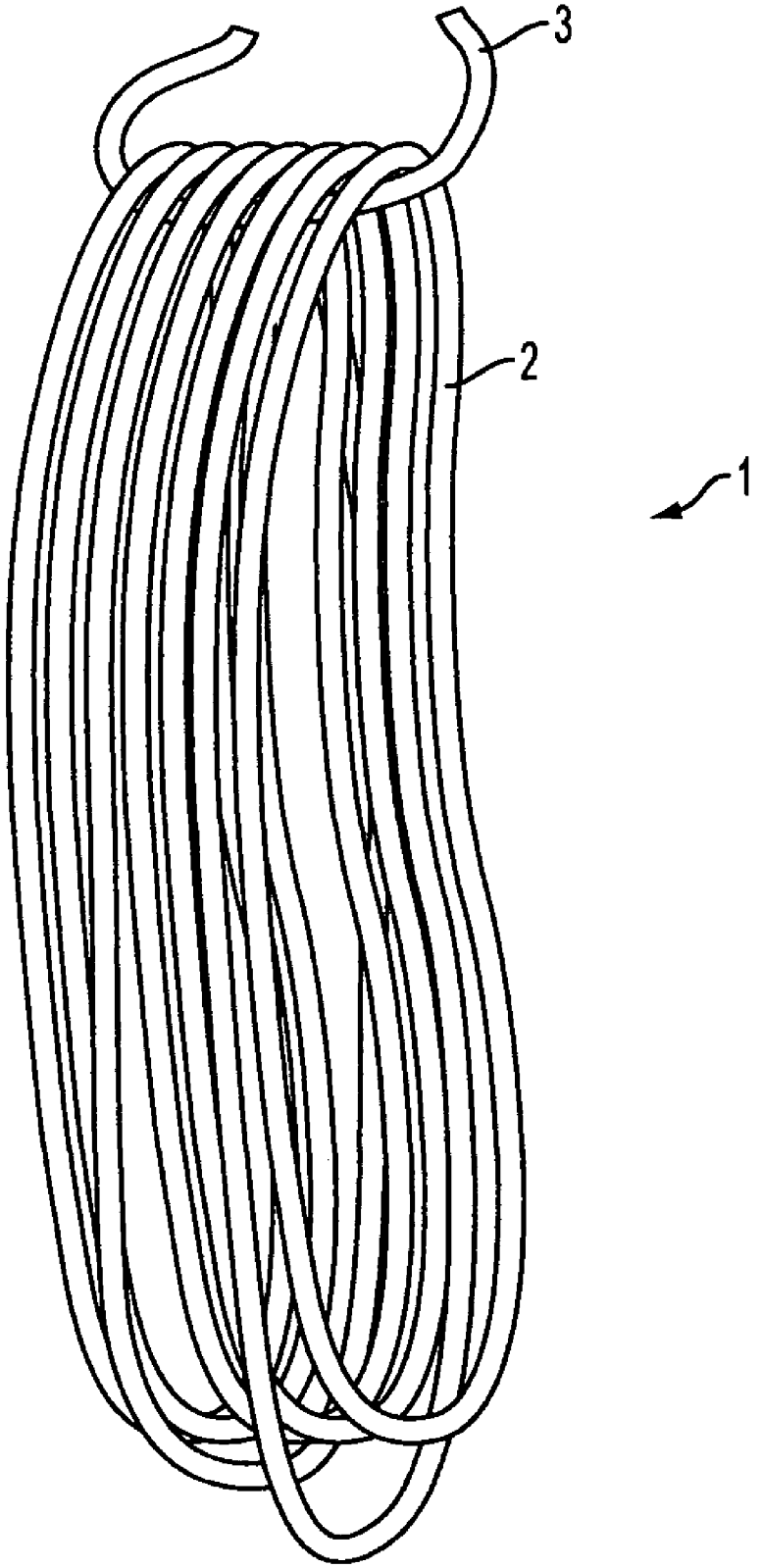
FIG. 6 is a perspective view following FIG. 5 showing the binding of the loops of fabric.

FIGS. 4-6 shows how the article of clothing 1 of the present invention is manufactured by a method comprising: providing a large tubular fabric material 5; cutting 6 a plurality of loops 2 of seamless fabric from the large tubular fabric material 5 at a desired width; stretching each of the loops 2 of fabric to a desired length and until the fabric rolls onto itself; providing a band of fabric 3 and using said band 3 to bind the plurality of loops 2 and thereby form a scarf 1 to be worn around a user's neck 10.

The fabric for the loops of fabric 2 and band 3 may be selected from a group comprising of cotton, polyester, silk, wool, cashmere, rayon, cotton jersey and mixtures thereof. The tubular fabric material 5 may be dyed with color, may be pre-printed with a design, or may be screen printed with a pattern prior to cutting.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. An article of clothing comprising:

more than three loops of seamless fabric cut from a larger tubular fabric material, wherein said more than three loops are stretched to allow fabric to roll onto itself, and a band of fabric adapted for binding said more than three loops of fabric to create an article of clothing adapted to be worn around a user's neck.

2. The article of clothing in claim 1 wherein said loops of fabric are cut at a width from about ¼ inch to about 4 inches.

3. The article of clothing in claim 1 wherein said loops of fabric are cut at a length from about 10 inches to about 30 inches.

4. The article of clothing in claim 1 wherein said loops of fabric are cut at a width from about ¾ of an inch to about 1 inch.

5. The article of clothing of claim 1 wherein said band of fabric binds said more than three loops of fabric using a fabric keychain loop knot.

6. The article of clothing of claim 5 wherein said knot is loose enough to allow each of said loops of fabric to slip through in any direction with ease.

7. The article of clothing of claim 1 wherein said article of clothing functions as a scarf.

8. The article of clothing in claim 1 wherein said more than three loops of fabric are manipulated to form at least two loops.

9. The article of clothing in claim 8 wherein at least one of said more than three loops is manipulated to create various looks.

10. The article of clothing in claim 1 wherein said tubular fabric material is dyed with color prior to cutting.

11. The article of clothing in claim 1 wherein said tubular fabric material is screen printed with a pattern prior to cutting.

12. The article of clothing in claim 1 wherein said loops of fabric are stretched to a length from about 16 inches to about 36 inches.

13. A scarf manufactured by a method comprising:

providing a large tubular fabric material;

cutting more than three loops of seamless fabric from said large tubular fabric material at a desired width;

stretching each of said loops of fabric to a desired length and until said fabric rolls onto itself;

providing a band of fabric and using said band to bind said more than three loops and thereby form a scarf to be worn around a user's neck.

14. The method of claim 13 wherein said loops of fabric are cut at a width from about ¼ inch to about 4 inches.

15. The method of claim 13 wherein said loops of fabric are stretched to a length from about 16 inches to about 36 inches.

16. The method of claim 13 wherein said band of fabric binds said plurality of loops of fabric using a fabric keychain loop knot.

17. The method of claim 13 wherein said fabric is selected from a group comprising of cotton, polyester, silk, wool, cashmere, rayon, cotton jersey and mixtures thereof.

18. The method of claim 13 wherein said tubular fabric material is pre-printed with a design prior to cutting.

19. The method of claim 13 wherein said tubular fabric material is screen printed with a pattern prior to cutting.

20. An article of clothing adapted to function as a scarf, said scarf comprising:

a large tubular fabric material cut into more than three loops of fabric, said loops of fabric are stretched to a desired length; and a band of fabric adapted to bind said more than three loops to thereby form said scarf designed to be worn around a user's neck.

* * * * *